US006758881B2

(12) United States Patent
Otani et al.

(10) Patent No.: US 6,758,881 B2
(45) Date of Patent: Jul. 6, 2004

(54) METAL-GRAPHITE BRUSH AND PRODUCTION METHOD THEREOF

(75) Inventors: Takayoshi Otani, Ise (JP); Osamu Takada, Matsusaka (JP); Mitsuo Ikeda, Matsusaka (JP); Yoichi Sakaura, Matsusaka (JP); Naoki Morita, Matsusaka (JP); Takahiro Sakamoto, Ise (JP); Kyoji Inukai, Toyota (JP); Youichi Murakami, Aichi (JP); Yasuyuki Wakahara, Kariya (JP); Masami Niimi, Handa (JP); Ryochi Honbo, Kariya (JP)

(73) Assignees: Tris Inc. (JP); Denso Corporation (JP)

( * ) Notice: Subject to any disclaimer, the term of this patent is extended or adjusted under 35 U.S.C. 154(b) by 0 days.

(21) Appl. No.: 10/396,751

(22) Filed: Mar. 25, 2003

(65) Prior Publication Data

US 2003/0190249 A1 Oct. 9, 2003

(30) Foreign Application Priority Data

Apr. 4, 2002 (JP) ..... 2002-102119

(51) Int. Cl.[7] ..... C22C 1/04; H01R 39/20

(52) U.S. Cl. ..... 75/231; 75/247; 252/503; 310/249; 310/252

(58) Field of Search ..... 75/231, 247; 419/10, 419/11, 23, 38; 252/503; 310/249, 252

(56) References Cited

U.S. PATENT DOCUMENTS

| | | | | |
|---|---|---|---|---|
| 2,989,490 A | * | 6/1961 | Ramadanoff | 252/503 |
| 3,300,667 A | | 1/1967 | Boes et al. | |
| 3,601,645 A | * | 8/1971 | Whitehurst | 310/219 |
| 4,642,201 A | | 2/1987 | Vogel | |
| 5,270,504 A | | 12/1993 | Grohs et al. | |
| 5,441,683 A | | 8/1995 | Kammerer et al. | |
| 5,630,973 A | | 5/1997 | Hoell et al. | |

FOREIGN PATENT DOCUMENTS

EP 0 627 795 12/1994

OTHER PUBLICATIONS

European Search Report for European Application No. EP 03 00 7283, completed Jul. 23, 2003.

* cited by examiner

*Primary Examiner*—Ngoclan T. Mai
(74) *Attorney, Agent, or Firm*—Webb Ziesenheim Logsdon Orkin & Hanson, P.C.

(57) ABSTRACT

Ag particles produced by chemical reduction and having a mean particle size of 5 μm are added by 0.05–3 wt % and Zn are added by 2–10 wt % to a Pb-less brush body containing graphite, Cu and a metal sulfide solid lubricant of a metal-graphite brush.

12 Claims, 3 Drawing Sheets

2

METAL-GRAPHITE BRUSH AND PRODUCTION METHOD THEREOF

FIELD OF THE INVENTION

The present invention relates to metal-graphite brushes containing a metal sulfide solid lubricant, which are used in automobile motors, etc., and in particular, relates to make the metal-graphite brushes substantially free of Pb.

PRIOR ART

Metal-graphite brushes have been used as brushes for low-voltage operation, such as brushes for automobile motors. Metal-graphite brushes are produced by mixing graphite and metal powder such as Cu powder, molding, and sintering the mixture. As they are operated at low voltages, their resistivities are lowered by compounding metal powder of which resistance is lower than that of graphite. A metal sulfide solid lubricant such as molybdenum disulfide or tungsten disulfide and Pb are added to metal-graphite brushes for heavy loads in most of the cases.

In recent years, Pb has been attracting greater attention as one of materials damaging to the environment, and a demand for Pb-less brushes is grown. Of course, brushes containing no Pb have been available up to the present and they have been used in some motors other than starting motors. Even some brushes for starting motors may be used by simply eliminating Pb from them, provided that they are used under normal service environments. To improve the lubricating properties without Pb, Japanese Patent Opening Hei 5-226048 (U.S. Pat. No. 5,270,504) proposes that a metal having a melting point lower than that of Cu is mixed in such a way that Cu and the metal do not form an alloy.

The inventors found that in metal-graphite brushes wherein a metal sulfide solid lubricant is added to Cu and graphite, the elimination of Pb results in an increase in the brush resistivity or an increase in the lead connection resistance under high temperature or high humidity. The above-mentioned Patent Opening Hei 5-226048 does not disclose any increase in the brush resistivity or in the lead connection resistance under high temperature or high humidity.

SUMMARY OF THE INVENTION

A primary object of the invention is to control the increase in the connection resistance of an outer terminal in a Pb-less metal-graphite brush containing a metal sulfide solid lubricant at high temperature.

A secondary object of the invention is to provide a specific structure for that.

A secondary object of the invention is to control the increase in the connection resistance of the outer terminal in high humidity as well as controlling the increase in the connection resistance of the outer terminal at high temperature.

A secondary object of the invention is to control the increase in the brush body resistivity as well as the increase in the outer terminal connection resistance at high temperature or in high humidity.

A secondary object of the invention is to obtain advantages with a small addition of Ag.

Moreover, a secondary object of the invention is to provide a production method of a metal-graphite brush which may be controlled the increase in the connection resistance of an outer terminal at high temperature.

A secondary object of the invention is to provide a production method of a metal-graphite brush which may be controlled the increase in the connection resistance of an outer terminal in high humidity as well as at high temperature.

A secondary object of the invention is to provide a production method of a metal-graphite brush which may be controlled the increase in the connection resistance of an outer terminal and the increase in the brush body resistivity at high temperature and in high humidity.

Further, an object of the invention is to provide a production method of a metal-graphite brush which may be controlled the increase in the connection resistance of an outer terminal and the increase in the brush body resistivity at high temperature and in high humidity.

In the invention, a metal-graphite brush, comprises: a Cu-graphite brush body added with a metal sulfide solid lubricant; and an outer terminal connected to the brush body, characterized in that Ag particles having a mean particle size of not more than 5 $\mu$m are added to at least one of the brush body and a neighborhood of connecting interface between the brush body and the outer terminal. The added Ag particles control the increase in the resistance between the brush body and the outer terminal at high temperature.

The metal sulfide solid lubricant is, for example, molybdenum disulfide or tungsten disulfide, and its addition is, for example, 1–5 wt % of the brush body. As molybdenum disulfide and tungsten disulfide are equivalent to each other, while molybdenum disulfide is used in the embodiment, the results are identical when it is substituted with tungsten disulfide. As for the outer terminal, for example, a lead wire being molded in the brush body is used. The lead wire may be, for example, a stranded wire or a braided wire of nonplated Cu wires. In the invention, expression such as addition of Ag particles, addition of Zn powder, addition of a metal sulfide solid lubricant, or Pb-less does not refer to Ag, Zn, a metal sulfide solid lubricant, or Pb being contained as an impurity.

As it is difficult to obtain Ag particles having a mean particle size of 5 $\mu$m or under from electrolytic silver, Ag particles used here are produced by chemical reduction. In the case, Ag particles are prepared by adding a reducing agent such as Zn, formalin, or ferrous ions to, for example, an aqueous solution of silver nitrate to reduce it. The kind of the reducing agent is optional, and the solvent for the solution is also optional. By the chemical reduction, Ag particles having a mean particle size of 5 $\mu$m or under may be easily obtained, and the mean particle size is, for example, from 1 to 3 $\mu$m. When silver nitrate is reduced by ferrous ions in the presence of, for example, citric acid, Ag black having a mean particle size of about 3–10 nm may be produced and this Ag black may be used as well. Thus, the mean particle size of chemically reduced silver is normally 3 nm–5 $\mu$m, preferably 0.1–5 $\mu$m, and most preferably 1–3 $\mu$m. Ag particles prepared by the chemical reduction are granular, or flaky when such particles are crushed by a stamp mill. In contrast to them, the particles of electrolytic silver have normally tree-like structure. Hence, electrolytic silver particles may be distinguished from Ag particles produced by the chemical reduction by the particle structure. The mean particle size of electrolytic silver is, for example, about 30 $\mu$m.

Preferably, in addition to the Ag particles, Zn is added to at least one of the brush body and the neighborhood of the connecting interface between the brush body and the outer terminal. This is effective in controlling the increase in the connection resistance of the outer terminal both at high temperature and in high humidity.

In the addition of Ag particles or Zn at least in a neighborhood of the connecting interface between the brush body and the outer terminal, preferably, each amount of the addition of Ag particles or Zn powder is 0.05–3 wt % or 2–10 wt % of the brush body material.

When Ag particles of 0.05–3 wt % of the entirety of the brush body or Zn of 2–10 wt % of the entirety of the brush body is almost homogeneously added to, for example, the brush body, the increase in the resistivity of the brush body as well as the increase in the connection resistance of the outer terminal may be controlled.

Ag particles are a precious material, and the usage of silver may be reduced by adding Ag particles and Zn only to a neighborhood of the connecting interface between the brush body and the outer terminal.

According to the invention, a production method of a metal-graphite brush having a brush body and an outer terminal, comprising a step for producing the brush body by sintering a compounded powder including graphite powder, Cu powder, and a metal sulfide solid lubricant, is characterized in that the compounded powder, to be used at least in a neighborhood of a connecting interface between the brush body and the outer terminal, further includes Ag particles produced by chemical reduction and having a mean particle size of not more than 5 $\mu$m by 0.05–3 wt % based on a weight after sintering.

Preferably, the compounded powder, to be used in at least the neighborhood of the connecting interface between the brush body and the outer terminal, further concludes Zn powder by 2–10 wt % of Zn based on a weight after sintering in addition to the Ag particles.

Preferably, the entirety of the brush body contains: the Ag particles produced by the chemical reduction and having the mean particle size of not more than 5 $\mu$m by 0.05–3 wt %; and the Zn powder by 2–10 wt % based on a weight after sintering.

More preferably, the compounded powder is blended to make the Zn powder disperse and contact with the Cu powder.

According to the invention, a production method of a metal-graphite brush having a brush body comprises: compounding and mixing graphite powder, a metal sulfide solid lubricant powder, Cu powder, Ag particles produced by chemical reduction and having a mean particle size of 5 $\mu$m, and Zn powder to a compounded powder; molding the compounded powder; and sintering the molded powder into the brush body.

Preferably, a content of the Ag particles is 0.05–3 wt % and a content of the Zn powder is 2–10 wt % based on a weight after sintering.

According to some experiments by the inventors, it was found that when metal-graphite brushes being substantially free of Pb and containing a metal sulfide solid lubricant were exposed to high temperatures, the resulted increases in the connection resistance of the outer terminal and in the resistance of the brush body were greater than those of brushes containing Pb. It was also found that such metal-graphite brushes showed larger increases in the connection resistance of the outer terminal and in the resistance of the brush body in high humidity than those of brushes containing Pb.

According to the experiments by the inventors, the increase in the lead connection resistance and the brush body resistivity under high temperature or high humidity is attributed to the metal sulfide solid lubricant. When the metal sulfide solid lubricant was not added, the lead connection resistance and the brush body resistivity did not increase substantially even under high temperature or high humidity. This is related to the presence or absence of Pb. When Pb was added, the lead connection resistance and the brush body resistivity hardly increased in such conditions. In Pb-less brushes, in correspondence with the increase in the lead connection resistance and the brush body resistivity, the copper powder and the lead embedded in the brush body showed a greater tendency to be oxidized under high temperature or high humidity.

The metal sulfide solid lubricant such as molybdenum disulfide or tungsten disulfide is added by the designer of the brush, but the metal sulfide solid lubricant is indispensable to brushes so as to have a long service life. Without metal sulfide solid lubricant, an excessive wear may be generated. In particular, this phenomenon is conspicuous in starter brushes to which Pb has been added. When Pb and the metal sulfide solid lubricant are eliminated simultaneously, the service life of the brush will be reduced significantly. Hence in many cases, the metal sulfide solid lubricant cannot be eliminated from Pb-less brushes.

The inventors estimated the mechanism by which the metal sulfide solid lubricant accelerates the oxidization of the copper powder and the embedded lead under high temperature or high humidity as follows: At the time of sintering the brushes, sulfur is liberated from the metal sulfide solid lubricant added to the brush and sulfur adsorbs on the surface of copper to produce copper sulfide. If moisture acts on copper sulfide under high humidity, strongly acidic copper sulfate will be produced to corrode severely the copper powder and Pb. Although the behavior of copper sulfide under high temperature is not certain in some aspects, it is estimated that copper sulfide is oxidized to increase the electrical resistance.

The mechanism by which Pb prevents the oxidization of the copper powder in the brush and the embedded lead is not known exactly. The inventors estimate that Pb contained in the brush partially evaporates at the time of sintering and coats the surface of copper in the form of a very thin Pb layer. And this Pb layer protects the inner copper from sulfate ion, etc.

The inventors searched for materials which may prevent, in place of Pb, the increases in the outer terminal connection resistance and the brush body resistivity at high temperature and in high humidity. Ag particles having a mean particle size of 5 $\mu$m or under were found to be effective in preventing the increases in the outer terminal connection resistance and the brush body resistivity at high temperature, and Zn was found to be effective in preventing the increases in high humidity. As Ag particles having a mean particle size of 5 $\mu$m or under are added to the brush body or the connecting interface between the brush body and the outer terminal in the invention, the increase in the outer terminal connection resistance at high temperature may be controlled. It should be noted that electrolytic silver powder having a mean particle size of about 30 $\mu$m, which is the silver powder used normally, could not control the increase in the outer terminal connection resistance at high temperature. Thus, to secure the function of Ag particles, it is important that the particle size of Ag particles is small.

When Zn is added in addition to Ag particles, the increase in the outer terminal connection resistance in high humidity may be controlled. The function of Zn seems to relate to the fact that Zn evaporates to coat surfaces of Cu during sintering.

When Ag particles and Zn are added only to a neighborhood of the connecting interface between the brush body and the outer terminal, the amounts of the additions may be kept low and the increase in the outer terminal connection resistance may be controlled, but the increase in the brush body resistivity cannot be controlled. In contrast to this, when Ag particles and Zn are added, for example almost homogeneously, to the brush body, both the increases in the outer terminal connection resistance and the brush body resistivity may be controlled.

It should be ensured that Zn evaporates during sintering to coat the surfaces of Cu, and it is not desirable to confine Zn in graphite powder. For example, it is preferable to fully mix graphite powder, Cu powder, a metal sulfide solid lubricant powder, Ag particles, and Zn powder to prepare a compounded powder.

To control the increases in the outer terminal connection resistance and the brush body resistivity at high temperature, it is preferable to set the concentration of Ag particles at 0.05–3 wt %, and to control the increases in the outer terminal connection resistance and the brush body resistivity in high humidity, it is preferable to set the concentration of Zn at 2–10 wt %.

Control of the oxidation due to a metal sulfide solid lubricant is particularly significant when nonplated Cu wire, which tends to be oxidized, is used as the lead wire.

EMBODIMENTS

Figure 1:
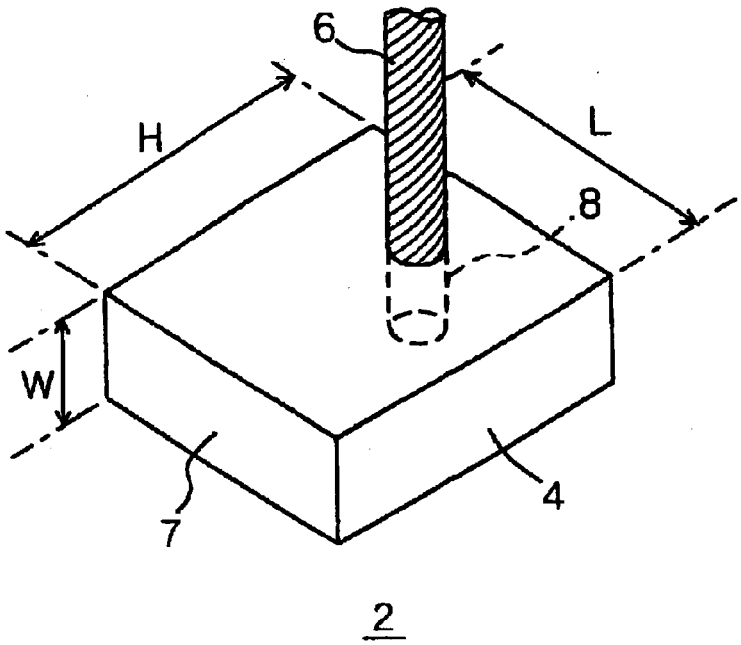
FIG. 1 is a perspective view of an embodiment of the metal-graphite brush of the invention.

FIG. 1 shows a metal-graphite brush 2 of an embodiment, and in the following, the metal-graphite brush is simply referred to as the brush. The brush is used, for example, as a brush for automobile motors, such as a brush of a starting motor. 4 denotes a brush body containing graphite, Cu, a metal sulfide solid lubricant, Ag, and Zn. 6 denotes a lead wire and is herein a stranded wire or a braided wire of nonplated Cu wires but it may be a Cu lead wire wherein the surfaces of wires are plated with nickel or the like. 7 denotes a face for contacting a commutator of a rotating machine. 8 denotes a lead side portion. The brush 2 is produced by molding a compounded powder with the top end of the lead wire 6 embedded therein and by sintering the molding in a reducing atmosphere or the like.

The metal sulfide solid lubricant may be, for example, molybdenum disulfide or tungsten disulfide. Its addition to the brush body 4 is preferably 1–5 wt %. If the addition is less than 1 wt %, its lubricating effect is not sufficient. If the addition is more than 5 wt %, the resistivity of the brush increases. The brush body 4 is substantially free of Pb. Preferably, Ag particles having a mean particle size of 5 μm or under are added to the brush body 4 to prevent increases in the resistivity and the lead wire connection resistance due to the metal sulfide solid lubricant at high temperature, and preferably, Zn is added to prevent the increases in the resistivity and the lead wire connection resistance in high humidity. In the following, Ag particles having a mean particle size of 5 μm or under are simply referred to as "Ag." When the mean particle size of silver to be added is greater than that, they are referred to, for example, as electrolytic silver or Ag powder having a mean particle size of 30 μm. Preferably, an amount of the Ag addition is 0.05–3 wt %. Even when the amount of the Ag addition is 0.1 wt %, it is effective in controlling the increases in the resistivity and the connection resistance of the lead wire at high temperature. However, to prevent these increases sufficiently, it is preferable to add Ag by 0.05 wt % or over. As Ag is a precious metal, it is uneconomical to add Ag by more than 3 wt %. The content of Zn is 2~10 wt %. Even when the Zn content is 1.5 wt %, it is effective in controlling the increases in the resistivity and the connection resistance of the lead wire in high humidity. However, to fully prevent such increases, it is preferable to add Zn by 2 wt % or over.

It should be noted that expressions such as "no addition" or "being substantially free of" indicate that the content of Pb or the content of a metal sulfide solid lubricant is not higher than the impurity level. The impurity level of Pb is 0.2 wt % or under, and the impurity level of a metal sulfide solid lubricant is 0.1 wt % or under. The impurity level of Zn is, for example, 0.05 wt % or under, and the impurity level of Ag is 0.001 wt % or under.

Figure 2:
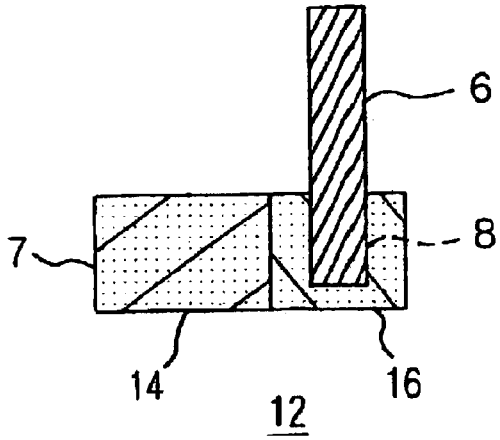
FIG. 2 is a sectional view of a modification of the metal-graphite brush.

FIG. 2 shows a brush 12 of a modification. In this brush 12, Ag being a precious element and Zn are added only to a neighborhood of the embedded portion 8 of the lead wire 6, and no Ag is added to a side with which a commutator is to be in contact 7 to reduce the usage of Ag. In this brush 12, the increase in the connection resistance of the lead wire at high temperature and in high humidity may be prevented. In FIG. 2, 14 denotes a commutator side member comprising Cu, graphite, and a metal sulfide solid lubricant. 16 is a lead side member comprising Cu, graphite, Ag, and Zn, or comprising Cu, graphite, Ag, Zn, and a metal sulfide solid lubricant. Even if no metal sulfide solid lubricant is added to the lead side member 16, sulfate ion or the like coming from the commutator side member 14 and a metal sulfide solid lubricant of the impurity level in the lead side member 16 will exert some effects. Hence, the addition of Ag and Zn is necessary.

Ag and Zn are added at least to a neighborhood of the embedded portion 8 of the lead wire 6. For example, a metal-graphite powder, to which Ag and Zn are added, is made to adhere to the top end of the lead wire, then this lead wire is set in the brush material to which no Ag nor Zn is added, and the material is molded. In such a case, however, the boundary of the portion to which Ag and Zn are added will not be clear. Hence the Ag concentration and the Zn concentration in the brush material in a neighborhood of the connecting interface between the lead wire 6 and the brush body are defined as the Ag concentration and the Zn concentration in the lead side member. The description of the brush 2 of FIG. 1 also applies to the brush 12 of FIG. 2 if not specified otherwise, and preferably, the Ag concentration is 0.05–3 wt % and the Zn concentration is 2.0–10 wt % in the lead side member 16.

Figure 3:
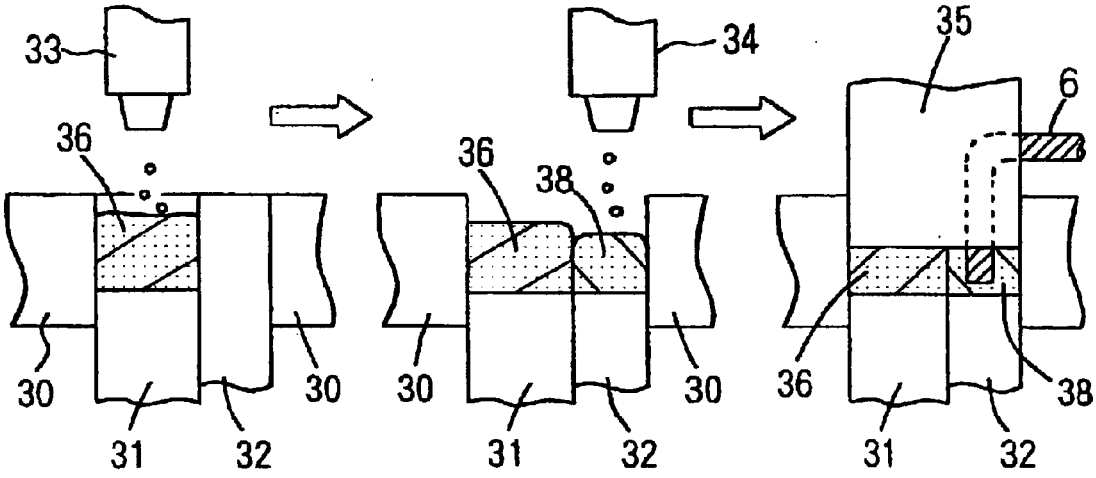
FIG. 3 schematically shows the production process of the modification of the metal-graphite brush.

The brush 12 of FIG. 2 is produced, for example, as shown in FIG. 3. A fixed die 30 is provided with, for example, a pair of lower movable dies 31, 32. A portion corresponding to the lead side member is first blocked by the lower movable die 32. Then a powder material 36, to which no Ag nor Zn is added, is fed from a first hopper 33. Next, the lower movable die 32 is retracted, and a powder material 38, to which Ag and Zn are added, is fed from a second hopper 34. Then an upper movable die 35 with the lead wire 6 being drawn out of the top end thereof is lowered so as to embed the top end of the lead wire 6, and they are shaped in a common mold. In this way, both the commutator side member and the lead side member are molded in a common mold, and at the same time the top end of the lead wire is molded. When the molding is sintered in a reducing atmosphere or the like, the brush 12 is obtained.

Figure 4:
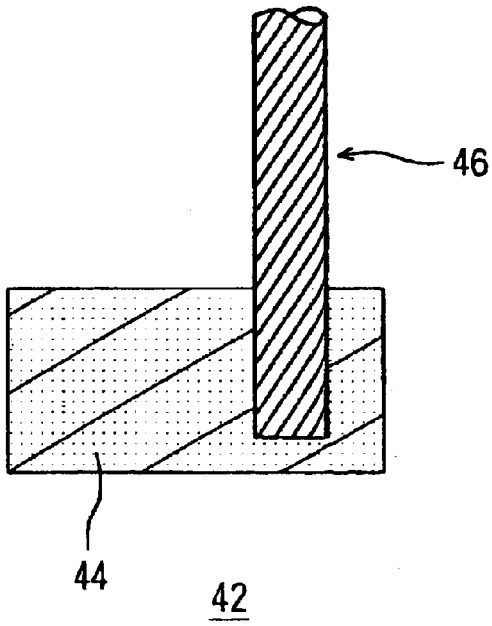
FIG. 4 is a sectional view of a second modification of the metal-graphite brush.
Figure 5:
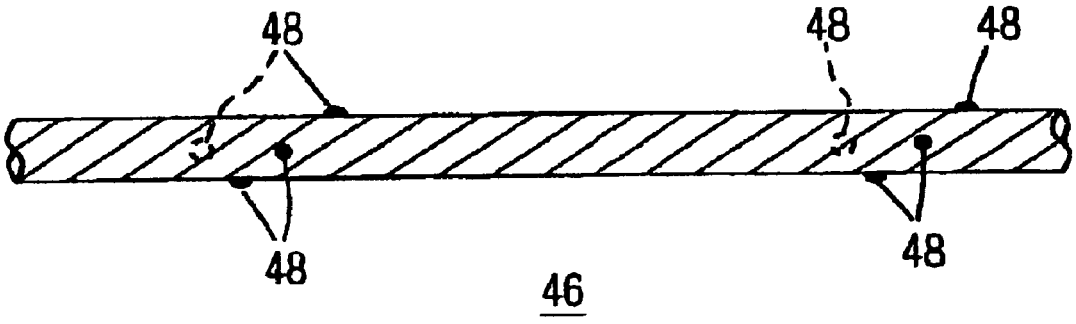
FIG. 5 schematically shows the lead wire which is used in the second modification.

FIG. 4 and FIG. 5 show a second modification. 42 denotes a new metal-graphite brush, and no Ag nor Zn is added to the powder material of the brush body 44. A lead wire 46 is a stranded wire or a braided wire of Cu. An Ag paste using Ag particles of a mean particle size of 5 μm or under and Zn powder are mixed and kneaded together, and the paste is spottedly applied to the lead wire 46 by means of a dispenser or a head of an ink jet printer. The spots of the paste serve as Ag & Zn sources 48. The Ag & Zn sources 48 are provided on a portion of the lead wire 46, the portion being to be embedded in the brush body 44. For example, the sources are located on the lead wire 46 in the direction of the length thereof at a plurality of points, for example, 3 or 4 points, on its circumference.

The lead wire 46 having the Ag & Zn sources 48 is used to mold and sinter the brush 42 in a manner similar to that of the conventional brush. In this modification, with small quantities of Ag and Zn, the increase in the lead connection resistance may be prevented. As an alternative to this, a Cu lead wire or the like, of which portion to be embedded in the brush body is plated with Zn, may be used to supply Zn, and Ag may be supplied independently of that by means of an Ag paste which uses Ag particles having a mean particle size of 5 μm or under. The description of the brush 2 of FIG. 1 also applies to the brush 42 of FIG. 4, if not specified otherwise.

EXAMPLES

In the following, examples will be described. The structure of the brush is as shown in FIG. 1, and the length H of the brush body 4 is 13.5 mm, the width L is 13 mm, and the thickness W is 6.5 mm. The lead wire 6 is a stranded wire of nonplated Cu wires, and its diameter is 3.5 mm and the depth of its embedded portion is 5.5 mm.

Example 1

20 parts by weight of novolak type phenol resin being dissolved in 40 parts by weight of methanol were mixed with 100 parts by weight of natural flaky graphite. They were homogeneously mixed and kneaded by a mixer, and the mixture was dried out by a drier to remove the methanol. The residue was crushed by an impact crusher and sieved with a sieve of 80 mesh pass (a 198 μm pass sieve) to obtain a resin-finished graphite powder.

54.9 parts by weight of electrolytic Cu powder having a mean particle size of 30 μm, 3 parts by weight of molybdenum disulfide powder, 0.1 part by weight of chemically reduced Ag powder (the shape is almost spherical) having a mean particle size of 3 μm which was measured by a laser particle size distribution analyzer, and 2.0 parts by weight of atomized Zn powder having a mean particle size of 30 μm were added to 40 parts by weight of the resin-finished graphite powder. They were homogeneously mixed by a V mixer to obtain a compounded powder. The compounded powder was put into the dies from the hopper, and the powder was molded under the pressure of $4\times10^8$ Pa ($4\times9800$ N/cm$^2$) in such a way that the top end of the lead wire 6 was embedded in the molding, and the molding was sintered in a reducing atmosphere in an electric furnace at 700° C. to obtain a brush of example 1. As a weight loss occurs to the graphite powder during sintering, the contents of Ag, Zn, Cu, and the metal sulfide solid lubricant after sintering increase by about 3% from those at the time of compounding. As for the measurement of the mean particle size by means of the laser particle size distribution analyzer, Ag particles are made to disperse in a liquid, and the mean particle size is determined from their scattering lights. In the embodiments, Coulter LS100 of Coulter Electronics Inc. was used as the laser particle size distribution analyzer (Coulter LS100 is a trade name).

Example 2

54.5 parts by weight of the electrolytic Cu powder, 3 parts by weight of molybdenum disulfide powder, 0.5 part by weight of Ag powder (chemically reduced Ag powder having a mean particle size of 3 μm), and 2.0 parts by weight of Zn powder were added to 40 parts by weight of the resin-finished graphite powder. They were treated in the same manner as example 1 regarding the other conditions to obtain a brush of example 2.

Example 3

55.1 parts by weight of the electrolytic Cu powder, 3 parts by weight of molybdenum disulfide powder, 2.9 parts by weight of Ag powder (chemically reduced Ag powder having a mean particle size of 3 μm) and 9 parts by weight of Zn powder were added to 30 parts by weight of the resin-finished graphite powder. They were treated in the same manner as example 1 regarding the other conditions to obtain a brush of example 3.

Example 4

56 parts by weight of the electrolytic Cu powder, 3 parts by weight of molybdenum disulfide powder, and 1 part by weight of Ag powder (chemically reduced Ag powder having a mean particle size of 3 μm) were added to 40 parts by weight of the resin-finished graphite powder. They were treated in the same manner as example 1 regarding the other conditions to obtain a brush of example 4.

Example 5

A brush of example 5 (Ag content: 1 part by weight) was obtained in the same manner as example 4 except the chemically reduced Ag powder having a mean particle size of 3 μm was changed to spherical Ag powder having a mean particle size of 2 μm.

Example 6

54 parts by weight of the electrolytic Cu powder, 3 parts by weight of molybdenum disulfide powder, and 3 parts by weight of Zn powder were added to 40 parts by weight of the resin-finished graphite powder. They were treated in the same manner as example 1 regarding the other conditions to obtain a brush of example 6.

Example 7

A brush of example 7 was obtained in the same manner as example 4 except 1 part by weight of Ag powder having a mean particle size of 3 μm was changed to 1 part by weight of electrolytic Ag powder (tree-like structure powder) having a mean particle size of 30 μm.

Example 8

55 parts by weight of the electrolytic Cu powder, 3 parts by weight of molybdenum disulfide powder, and 2 parts by weight of Pb powder were added to 40 parts by weight of the resin-finished graphite powder used in example 1. They were treated in the same manner as example 1 regarding the other conditions to obtain a brush of example 8. This brush is a conventional brush containing Pb.

Example 9

57 parts by weight of the electrolytic Cu powder, and 3 parts by weight of molybdenum disulfide powder were added to 40 parts by weight of the resin-finished graphite powder used in example 1. They were treated in the same manner as example 1 regarding the other conditions to obtain a brush of example 9. This brush is a conventional Pb-free brush.

The concentration of each component in the brushes after sintering increases by about 3% because the novolak type phenol resin is partially decomposited to loss a weight during sintering. The contents of the metal sulfide lubricant, Pb, Ag, and Zn in the brushes of examples 1–9 are shown in Table 1. A content 0% in Table 1 indicates that the content is at an impurity level.

TABLE 1

Contents of the metal sulfide lubricant, Pb, Ag, and Zn in the brushes of examples 1–9

| Sample | Lubricant content (%) | Pb content (%) | Ag content (%) | Ag Mean particle size (μm) | Zn content (%) |
|---|---|---|---|---|---|
| Example 1 | 3.1 | 0 | 0.1 | 3 | 2.1 |
| Example 2 | 3.1 | 0 | 0.5 | 3 | 2.1 |
| Example 3 | 3.1 | 0 | 3.0 | 3 | 9.3 |
| Example 4 | 3.1 | 0 | 1.0 | 3 | 0 |
| Example 5 | 3.1 | 0 | 1.0 | 2 | 0 |
| Example 6* | 3.1 | 0 | 0 | — | 3.1 |
| Example 7* | 3.1 | 0 | 1.0 | 30 | 0 |
| Example 8* | 3.1 | 2.0 | 0 | — | 0 |
| Example 9* | 3.1 | 0 | 0 | — | 0 |

*Examples 6–9 are comparative examples.

Only Zn was added in example 6, and electrolytic Ag powder having a mean particle size of 30 μm was added in example 7.

Example 8 represents a conventional brush containing Pb, and example 9 represents a conventional Pb-less brush.

The brushes of examples 1–9 were put in an electric oven at 200° C. to force them to be oxidized, and their lead connection resistances were measured periodically. The changes in the lead connection resistances resulting from the exposure to 200° C. are shown in Table 2.

Moreover, the brushes of examples 1–9 were put in a constant-temperature & constant-humidity vessel having a temperature of 80° C. and a relative humidity of 85% to expose them to high humidity to force Cu to be oxidized, and their lead connection resistances were measured periodically. The changes in the lead connection resistances in the high humidity are shown in Table 3. The number of the measurements was ten for each, and the arithmetic mean was used. The measurement of the lead connection resistance was made in accordance with the method described in Japan Carbon Association Standard JCAS-12-1986 "Method of testing the lead connection resistance of brushes for electrical machines." Moreover, the resistivity of the each brush body was measured by the four-terminal method, in the direction perpendicular to the pressing direction at the time of brush molding, before and after the 200° C. exposure test. The changes in the resistivities of the brush bodies before and after the 200° C. exposure test are shown in Table 4. Moreover, the resistivities of the brush bodies were measured by the four-terminal method in a direction perpendicular to the pressing direction at the time of brush molding before and after the exposure test to a temperature of 80° C. and a relative humidity of 85%. The changes in the resistivities of the brush bodies before and after the exposure test to a temperature of 80° C. and a relative humidity of 85% are shown in Table 5.

TABLE 2

Changes in the lead connection resistances due to the 200° C. exposure

| Sample | Lead connection resistance (unit: mV/200A) | | | | | | | | |
|---|---|---|---|---|---|---|---|---|---|
| Number of days | Initial value | 1 | 2 | 3 | 4 | 5 | 7 | 10 | 15 |
| Example 1 | 22.6 | 23.7 | 24.6 | 25.3 | 26.7 | 28.4 | 29.9 | 34.9 | 36.8 |
| Example 2 | 22.6 | 23.9 | 24.3 | 25.2 | 26.4 | 28.6 | 31.2 | 33.2 | 34.6 |
| Example 3 | 26.8 | 27.1 | 27.7 | 28.1 | 28.3 | 28.8 | 29.6 | 30.9 | 31.7 |
| Example 4 | 21.8 | 23.8 | 24.5 | 26.1 | 27.9 | 29.1 | 30.6 | 32.0 | 33.1 |
| Example 5 | 22.1 | 23.1 | 24.2 | 25.8 | 26.7 | 28.2 | 29.4 | 30.2 | 32.1 |
| Example 6 | 23.3 | 26.4 | 33.4 | 45.3 | 58.6 | 72.3 | 89.2 | 118 | 138 |
| Example 7 | 22.3 | 25.8 | 36.5 | 48.5 | 62.8 | 81.6 | 95.6 | 118 | 128 |
| Example 8 | 22.4 | 24.0 | 24.8 | 25.8 | 26.7 | 28.4 | 30.4 | 33.1 | 35.2 |
| Example 9 | 22.2 | 26.8 | 35.1 | 46.8 | 60.2 | 73.4 | 90.8 | 122 | 146 |

*Examples 6–9 are comparative examples.

TABLE 3

Changes in the lead connection resistances due to the exposure to a temperature of 80° C. and a relative humidity of 85%

| Sample | Lead connection resistance (unit: mV/200A) | | | | | | | | |
|---|---|---|---|---|---|---|---|---|---|
| Number of days | Initial value | 1 | 2 | 3 | 4 | 5 | 7 | 10 | 15 |
| Example 1 | 22.9 | 23.6 | 25.1 | 26.4 | 27.3 | 30.1 | 32.3 | 35.1 | 36.9 |
| Example 2 | 22.8 | 23.4 | 24.5 | 26.3 | 27.5 | 29.1 | 32.1 | 34.6 | 37.2 |
| Example 3 | 27.1 | 27.9 | 28.6 | 29.6 | 31.2 | 32.6 | 33.4 | 35.2 | 36.8 |
| Example 4 | 23.9 | 86.4 | 178 | 286 | 386 | 445 | 486 | 512 | 541 |
| Example 5 | 23.5 | 81.2 | 156 | 238 | 288 | 320 | 404 | 412 | 458 |
| Example 6 | 23.5 | 24.6 | 25.8 | 26.9 | 28.1 | 29.6 | 31.0 | 32.4 | 35.4 |
| Example 7 | 22.4 | 90.6 | 168 | 276 | 397 | 435 | 455 | 482 | 496 |
| Example 8 | 22.8 | 23.1 | 24.6 | 25.7 | 26.8 | 28.9 | 29.5 | 32.0 | 33.1 |
| Example 9 | 22.6 | 101 | 195 | 294 | 402 | 489 | 561 | 593 | 614 |

*Examples 6–9 are comparative examples.

TABLE 4

Changes in the resistivities before and after the 200° C. exposure

| Sample | Brush body resistivity (unit: $\mu\Omega \cdot$ cm) Initial value | After the high temperature test |
|---|---|---|
| Example 1 | 56.1 | 73.4 |
| Example 2 | 55.3 | 71.2 |
| Example 3 | 75.4 | 86.4 |
| Example 4 | 53.9 | 68.4 |
| Example 5 | 54.2 | 67.5 |
| Example 6 | 56.2 | 128 |
| Example 7 | 51.3 | 139 |
| Example 8 | 56.1 | 78.4 |
| Example 9 | 55.4 | 136 |

*Examples 6–9 are comparative examples.

TABLE 5

Changes in the resistivities before and after the exposure to 80° C. and a relative humidity of 85%

| Sample | Brush body resistivity (unit: $\mu\Omega \cdot$ cm) Initial value | After the high temp. & high humidity test |
|---|---|---|
| Example 1 | 55.3 | 64.2 |
| Example 2 | 54.2 | 63.8 |
| Example 3 | 74.6 | 79.5 |
| Example 4 | 54.5 | 294 |
| Example 5 | 54.6 | 287 |
| Example 6 | 54.1 | 62.4 |
| Example 7 | 53.8 | 258 |
| Example 8 | 55.6 | 58.2 |
| Example 9 | 55.3 | 312 |

*Examples 6–9 are comparative examples.

In the Pb-less brush of example 9, the lead connection resistance and the resistivity of the brush body increased markedly at high temperature and in high humidity. The conditions of 80° C. and a relative humidity of 85% were those of an accelerated test. However, even at the ordinary temperature, when the brush is exposed to high humidity over a long period, the brush will be oxidized, and the lead connection resistance and the resistivity will rise as well. In contrast to it, when only Ag powder was added like examples 4 and 5, the increase in the resistance at high temperature could be prevented, but the increase in the resistance in high humidity could not be prevented. When only Zn powder is added like example 6, conversely, the increase in the resistance in high humidity could be prevented, but the increase in the resistance at high temperature could not be prevented. When both Ag and Zn were added like examples 1–3, the brushes showed no changes in the resistance at high temperature and in high humidity.

The increase in the lead connection resistance at high temperature and in high humidity may be prevented by adding Ag and Zn to the compounded powder of a neighborhood of the embedded portion of the lead wire or by supplying Ag and Zn from the lead wire, although such cases were not represented by examples. As for the mean particle size of Ag, cases of 2 $\mu$m and 3 $\mu$m were examined, but similar results may be obtained when the mean particle size is 5 $\mu$m or under. The role of Ag is considered to be that fine Ag particles are present in the interface between the lead wire and the brush body or between a Cu grain and a Cu grain in the brush body and prevent oxidation at high temperature or keep the resistance at the interface low. As Zn is a volatile metal, Zn seems to evaporate to diffuse into the interface between the lead wire and the brush body during sintering to cover surfaces of Cu and to prevent the oxidation of the Cu surfaces in high humidity.

What is claimed is:

1. A metal-graphite brush, comprising: a Cu-graphite brush body added with a metal sulfide solid lubricant; and an outer terminal connected to the brush body, wherein Ag particles having a mean particle size of not more than 5 $\mu$m are added to at least one of said brush body and a neighborhood of connecting interface between said brush body and said outer terminal.

2. A metal-graphite brush of claim 1, wherein said Ag particles are produced by chemical reduction.

3. A metal-graphite brush of claim 1, wherein in addition to said Ag particles, Zn is added to at least one of said brush body and the neighborhood of the connecting interface between said brush body and said outer terminal.

4. A metal-graphite brush of claim 3, wherein an amount of said Ag particles added is 0.05–3 wt % of a material of said brush body in at least the neighborhood of the connecting interface between said brush body and said outer terminal, and that an amount of said Zn added is 2–10 wt % of the material of said brush body in at least the neighborhood of the connecting interface between said brush body and said outer terminal.

5. A metal-graphite brush of claim 3, wherein an amount of said Ag particles added is 0.05–3 wt % of the entirety of said brush body, and an amount of said Zn added is 2–10 wt % of the entirety of said brush body.

6. A metal-graphite brush of claim 3, wherein said Ag particles and Zn are added only to the neighborhood of the connecting interface between said brush body and said outer terminal.

7. A production method of a metal-graphite brush having a brush body and an outer terminal, comprising a step for producing the brush body by sintering a compounded powder including graphite powder, Cu powder, and a metal sulfide solid lubricant, wherein the compounded powder, to be used at least in a neighborhood of a connecting interface between said brush body and the outer terminal, further includes Ag particles produced by chemical reduction and having a mean particle size of not more than 5 $\mu$m by 0.05–3 wt % based on a weight after sintering.

8. A production method of a metal-graphite brush of claim 7, wherein the compounded powder, to be used in at least the neighborhood of the connecting interface between said brush body and the outer terminal, further concludes Zn powder by 2–10 wt % of Zn based on a weight after sintering in addition to said Ag particles.

9. A production method of a metal-graphite brush of claim 8, wherein the entirety of said brush body contains: the Ag particles produced by the chemical reduction and having the mean particle size of not more than 5 $\mu$m by 0.05–3 wt %; and the Zn powder by 2–10 wt % based on a weight after sintering.

10. A production method of a metal-graphite brush of claim 8, wherein the compounded powder is blended to make the Zn powder disperse and contact with the Cu powder.

11. A production method of a metal-graphite brush having a brush body comprising: compounding and mixing graphite powder, a metal sulfide solid lubricant powder, Cu powder, Ag particles produced by chemical reduction and having a mean particle size of 5 $\mu$m, and Zn powder to a compounded powder; molding the compounded powder; and sintering the molded powder into the brush body.

12. A production method of a metal-graphite brush of claim 11, wherein a content of said Ag particles is 0.05–3 wt % and a content of the Zn powder is 2–10 wt % based on a weight after sintering.

* * * * *

UNITED STATES PATENT AND TRADEMARK OFFICE

CERTIFICATE OF CORRECTION

PATENT NO. : 6,758,881 B2
DATED : July 6, 2004
INVENTOR(S) : Otani et al.

It is certified that error appears in the above-identified patent and that said Letters Patent is hereby corrected as shown below:

Title page,
Item [75], Inventors, "Ryochi Honbo" should read -- Ryoichi Honbo --

Signed and Sealed this

First Day of February, 2005

JON W. DUDAS
*Director of the United States Patent and Trademark Office*